United States Patent [19]

Storm

[11] 4,161,861

[45] Jul. 24, 1979

[54] METHOD AND APPARATUS FOR FORMING AN EYE IN CORDAGE

[76] Inventor: Russell F. Storm, 115 Walnut, Windsor, Ill. 61957

[21] Appl. No.: 915,502

[22] Filed: Jun. 14, 1978

[51] Int. Cl.[2] ..... D01H 15/00

[52] U.S. Cl. ..... 57/22; 57/202

[58] Field of Search ..... 57/22, 142, 159, 202

[56] References Cited

U.S. PATENT DOCUMENTS

| | | | |
|---|---|---|---|
| 1,334,244 | 3/1920 | Howe | 57/159 |
| 2,967,391 | 1/1961 | Himick et al. | 57/142 |
| 3,122,878 | 3/1964 | Meals | 57/159 X |
| 3,472,121 | 10/1969 | Johansen | 57/159 X |

*Primary Examiner*—Donald Watkins

*Attorney, Agent, or Firm*—Neuman, Williams, Anderson & Olson

[57] ABSTRACT

An apparatus and method for forming an eye at the end of a multiple-stranded rope, string or other cordage by dividing the strands into bundles, twisting them longitudinally, overlapping the end portions and reverse twisting them to form a flemish eye. The apparatus includes a frame and rotatable strand retaining clamps to retain and twist the strands of the string to form the desired eye, a string retaining means to help position the string, and rotating means to rotate the strand retaining clamps in either direction.

35 Claims, 9 Drawing Figures

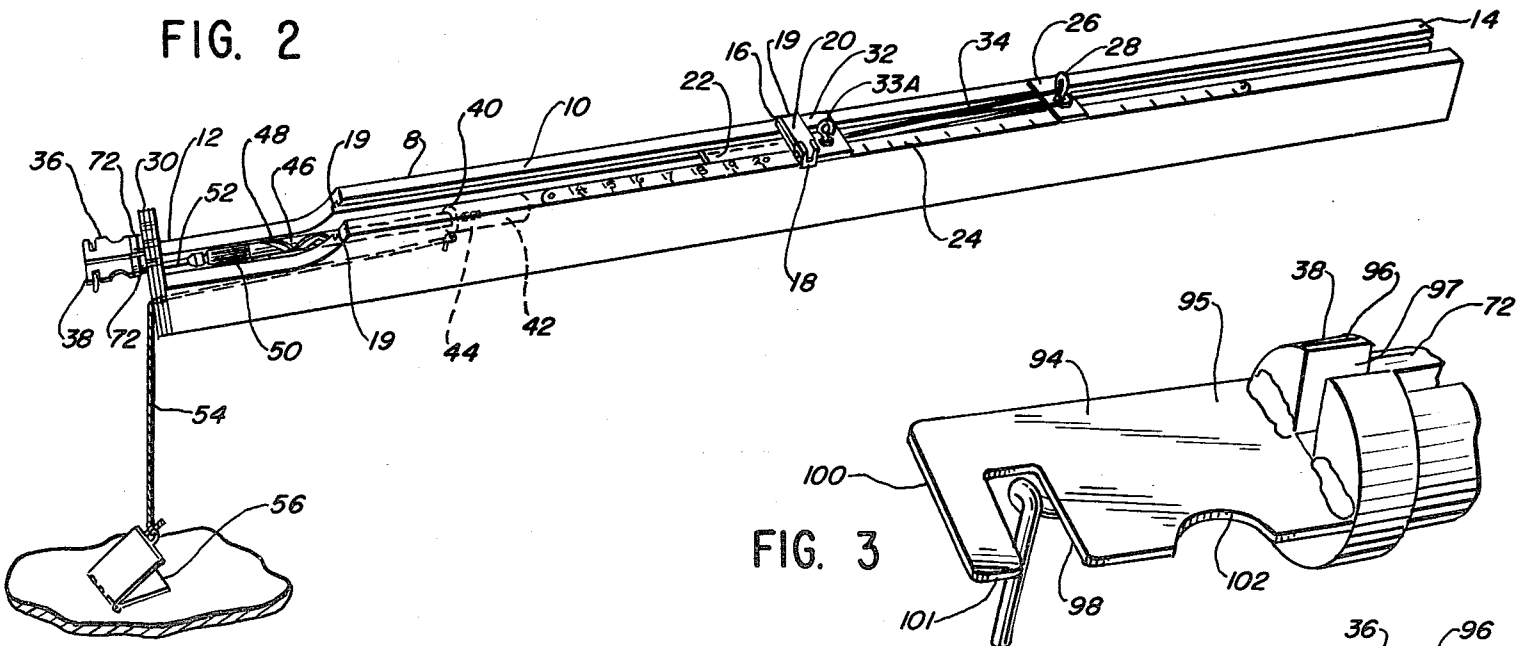
FIG. 2
FIG. 3
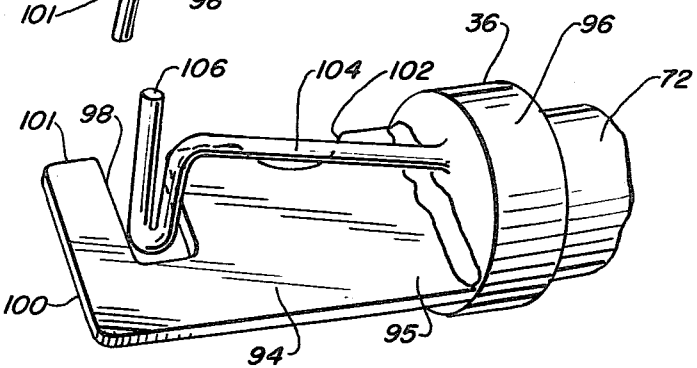
FIG. 4
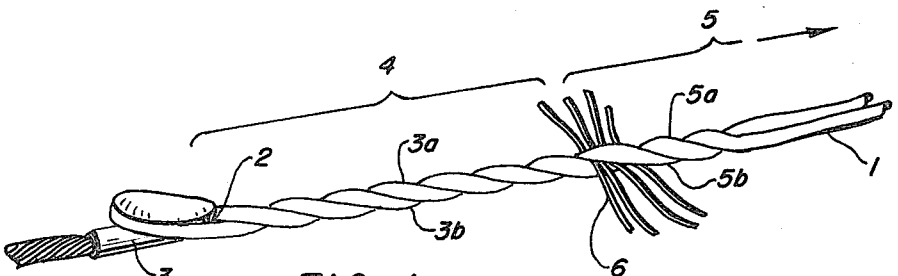
FIG. 1

METHOD AND APPARATUS FOR FORMING AN EYE IN CORDAGE

BACKGROUND OF THE INVENTION

This invention relates generally to forming an eye at the end of a string or other rope-like item having a plurality of strands by dividing the strands into bundles or readies, twisting each bundle about its longitudinal axis, laying them over each other, and twisting them again back into the body of the string.

As used herein, the terms string, rope and bowstring each shall mean cordage of the indicated type comprising multiple discrete strands of which may be separated into multiple discrete strands extending generally parallel to one another longitudinally of the cordage.

While an eye may be woven into rope, string, or other cordage, it has found recent favor with archers for use in fabricating bowstrings. Most bowstring blanks are comprised of several strands wrapped near the middle of their length by a serving for placement of arrow notches when the bow is in use. In the past, bowstrings were of a specific predetermined non-variable length. The eyes or loops at each end of the bowstring were formed by splicing the ends of the strands back into the body of the string and wrapping the splice and loop circumferentially by a serving, thereby making it virtually impossible to change the string's length. This was done, in part, to provide a larger and stronger eye to fit over the wider limb nock at the end of a bow. Because the strength of or energy delivered by a bow is related to its degree of flexure, the string length is critical and a string with conventional loops and servings can be used to fit at only a single length.

By dividing the strands of one end of the string into bundles, twisting the bundles longitudinally, laying the ends over each other, and twisting the ends back into the body of the string, one may form an eye at the end of the string, sometimes referred to as a flemish eye. Although the flemish eye is known, its use has been severely limited and almost non-existant for archery due to the difficulty in properly making the eye and in accurately controlling the overall length of the finished string. As a result, archers have found it necessary to use the less desirable fixed length bowstring utilizing splices wrapped by a serving.

The presently disclosed apparatus and method of forming said eye provides a unique solution to the problems of manufacturing the more desirable bowstrings incorporating a flemish eye. Fabrication of a flemish eye, according to the teachings of the present invention, allows one to quickly, simply, and accurately position the eyes at the ends of a bowstring, thereby insuring a string of the desired length. Once fabricated, the eye will remain indefinitely until disassembled by the archer. This permits the added efficiency, convenience, and control of being able to readily use a bowstring blank at any length or quickly change its length to adjust string tension and bow flexure. This latter feature is of prime importance to those using modern day archery equipment, such as a two wheel compound bow.

OBJECTS OF THE INVENTION

It is an object of the present invention to provide apparatus and an improved method for making an eye in a rope, string, or other cordage having a plurality of strands.

It is a further object of the invention to provide apparatus and an improved method for making an eye in a rope or string by dividing the strands of the string, twisting them longitudinally, laying them over each other, and twisting the ends back into the body of the string.

It is a further object of the invention to provide apparatus and an improved method for making ropes or strings of a specific, desired length with an eye on each end.

It is a specific object of the present invention to provide apparatus and an improved method for making eyes at the ends of bowstrings which may be readily removed if desired, in order to reuse a bowstring or adjust the length thereof.

It is still a further object of the present invention to provide apparatus and an improved method for making eyes at the ends of ropes or strings in a very short period of time.

These and other objects will become readily apparent from the present specification, drawings, and appended claims.

SUMMARY OF THE INVENTION

The invention includes apparatus for making an eye in a string, rope, or other cordage having a plurality of strands. The apparatus includes a first retaining means for releasably retaining strands of a string and longitudinally twisting at least two bundles of strands of said string, i.e. about their longiutdinal axis. A second retaining means is spaced apart from the first retaining means for gripping and retaining a portion of said string and may be placed in a plurality of positions spaced apart from said first retaining means. A rotating means is provided for rotating the first retaining means in either direction.

A method for making an eye in such a string includes splitting the strands of the string into first and second bundles and longitudinally turning each of these bundles in a first direction to provide a reverse twist in the main body section of the string. A distal end portion of the first bundle is then overlapped with a distal end portion of the second bundle to form a bight constituting the overlapped or double bundle portion. Said bight is releasably retained at its midpoint and the two segments or legs formed thereby are each twisted about its own longitudinal axis in a second direction opposite said first direction which also causes the legs of the bight to entwine one around the other forming an eye at said midpoint of the bight while unwinding the body section to a normal parallel untwisted state.

DESCRIPTION OF THE DRAWINGS

FIG. 1 is a perspective view of a flemish eye made in accordance with teachings of the present invention, said eye placed over a retaining end.

FIG. 2 is a perspective view of a splicing apparatus employing teachings of this invention.

FIG. 3 is a perspective view of one side of a rotatable strand retaining means.

FIG. 4 is a perspective view of a second side of a rotatable strand retaining means.

DESCRIPTION OF THE PREFERRED EMBODIMENT

Figure 5:
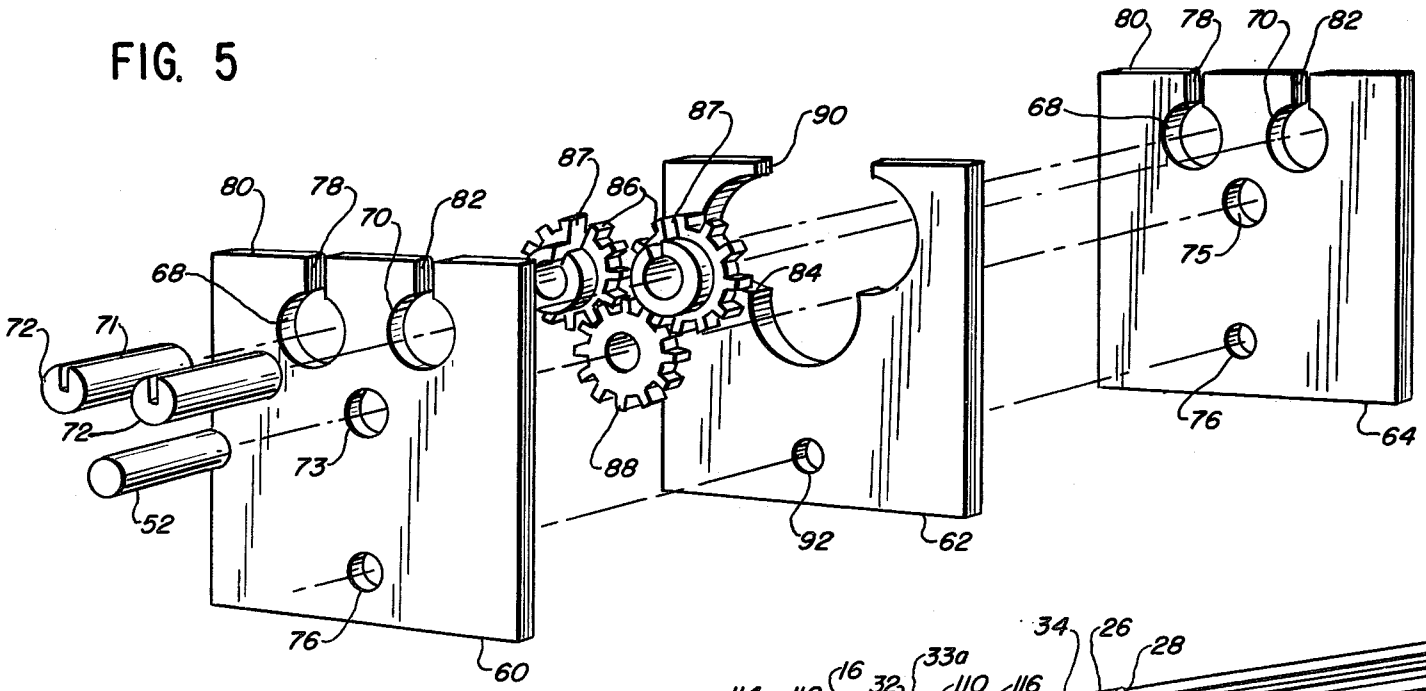
FIG. 5 is an exploded view of a preferred embodiment of a portion of a rotation means for a rotatable strand retaining means.

Referring now to FIG. 1, a string 1 comprising a plurality of strands has an eye 2 that is placed over a retaining end 3, such as may be used for a compound bow. A first entwined portion 4 of said string 1 comprises end portions of the strands folded back on themselves to form a closed loop which provides the eye 2. The strands form two bundles 3*a* and 3*b*, each of which is twisted together, and the two twisted bundles are twisted or laid together as illustrated. The ends 6 of the strands are twisted in among the strands themselves for retention to form the loop of said first entwined portion 4. Because of the overlap, the portion 4 has an average diameter generally larger than the average diameter of a second portion 5 of the string 1. Said second portion 5 includes the strands of the string 1 entwined in two bundles 5*a* and 5*b* and laid together over a short length adjacent the first portion 4 to retain the ends 6 in place and prevent any undesired unraveling. At the opposite end of portion 5 the strands remain separated and parallel.

As seen in FIG. 2 of the drawings, an apparatus 8 for making an eye in a string or rope includes an elongated frame 10 having a first end 12 and a second end 14. The frame 10 is of generally channel-shaped or U-shaped cross-section in the preferred embodiment but may take a variety of convenient shapes. Mediate said first and second ends is a freely slidable string clamp 16. The clamp 16 includes a base portion 18 and an opposed pivoted clamping portion 20 which cooperates with the base portion 18 to releasably retain a string. A latch 19 holds the clamping portion 20 adjacent the base 18. In the case of a bowstring, said clamp 16 retains the center of the center serving of the string. Said clamp 16 is attached to a sliding means such as a block 22 which is slidably mounted on frame 10 in any convenient manner, e.g. in slots 19 in the interior cavity of the frame 10, so that the position of the clamp 16 may vary between the first end 12 and the second end 14 of the frame 10. Said string clamp 16 may swivel with respect to the sliding means 22 to permit either end of a string to be positioned toward a splicing head 30 attached to the frame 10 at the first end 12.

A string length stop 32 is slidably mounted on frame 10 in any convenient manner so that it may be releasably fixed in any position between the first end 12 and the second end 14 of the frame 10. In the illustrated embodiment, the stop 32 is a clamp including a plate (not shown) which slides in the slots 19 in a manner similar to that for mounting the sliding means 22 on the frame 10. A top plate 33 rides atop the frame 10, and an eyebolt 33*a* joins the plates to provide a clamping action for fixing the stop 32 in any selected stop position along the frame 10. The string clamp 16 normally abuts said stop 32. The relative position of said string clamp 16 or said stop 32 with respect to the splicing head 30 may be determined by reference to a string length scale 24 on the frame 10. Said scale 24 may be a ruler or any other length measuring indicia.

A tensioning means 26 also is slidably mounted on the frame 10 in any convenient manner to be releasably fixed in any selected position between the first end 12 and the second end 14 of the frame 10. Any conventional means suitable for use with the desired frame may be employed for the tensioning means 26. In the illustrated embodiment, means 26 is of the same slidable clamp construction and mounting as stop 32. An elastic tension element 34 engages a post 28 or other suitable connector on the tensioning means 26 and a post or other suitable connector (not shown) on the slide 22 to urge the string clamp 16 away from the splicing head 30 and toward the string length stop 32. The tensioner 34, which passes freely between the plates of stop 32, need only hold the string clamp 16 in an initial position against the string length stop 32 when the splicing operation commences. As splicing progresses, the twisting of the strands may vary the effective string length and draw the bowstring clamp 16 towards the splicing head 30. While tension in this portion of the string is not necessary, it is desirable in order to prevent tangling of the strands of said string.

A splicing head 30 is attached to the first end 12 of the frame 10. A righthand strand clamp 38 and a lefthand strand clamp 36 each is rotatably attached to the splicing head 30 by a shaft 72 or other means for rotation independent of said head 30. A rotary drive means 40 is connected to said strand clamps 36 and 38 in any conventional manner to rotate the clamps in either direction a desired number of turns. This may be done manually or automatically as desired. In the illustrated embodiment, the drive 40 includes means for converting reciprocating motion to rotary motion, such as that used in "automatic" screwdrivers or hand operated drills. A reciprocable control head 42, including a reversing switch 44, is concentric with and engages a shaft 46 having helical grooves 48 to translate the reciprocating motion of the control head 42 into rotary motion of said shaft 46. Trunnions and bearings (not shown) may be secured to the head 42 and engage the slots 19 to guide and control the movement of the reciprocating head. A coupling 50 connects said shaft 46 to a driving shaft 52, to rotate said strand clamps 36 and 38 by conventional means, such as gears 86 and 88 (see FIG. 5). A cable 54 and a foot pedal 56, together with a return spring (not shown), may be used to reciprocate said head 42 and thereby to rotate the shaft 46. The setting of the reversing switch 44 determines the direction of rotation of the shaft 46 and hence of the clamps 36 and 38.

Referring now to FIG. 5, the splicing head 30, in the preferred embodiment, comprises three rectangular laminated plates, namely a first plate 60, a second gear housing plate 62, and a third plate 64 which is substantially identical to said first plate in the preferred embodiment. The first plate 60 has two shaft apertures 68 and 70 to separately receive the two driven shafts 72, an aperture 73 to receive a driving gear shaft 52, and may include an aperture 76 to pass the cable 54 or other means to operate a manual rotating means 40. First plate 60 further includes an access slot 78 extending radially from aperture 68 to edge 80 and a slot 82 extending radially from aperture 70 to edge 80. Each of said slots 78 and 82 aligns with a radial slot 71 cut from the center of the respective shaft 72 to its periphery and extending the length thereof. The purpose of these slots is to admit strands of a string, as described further below.

Second gear housing plate 62 includes a trefoil-shaped opening 84 comprising three overlapping generally circular apertures whose centers are coincident with the centers for the three shaft apertures 68, 70 and 73 of the first plate 60. The radius of each generally circular aperture comprising opening 84 is greater than the respective radius of each gear housing within said second plate 62. Said gears include two driven gears 86, each of which has a radial slot 87 extending from its center to its circumference and each of which is attached to a slotted shaft 72 with the gear slots 87 in alignment with the shaft slots 71. A driving gear 88 is attached to said driving gear shaft 52. A port 90 in second plate 62 is as wide as and in line with the outer wall of slot 78 and the outer wall of slot 82 in first plate 60, and extends to and merges with opening 84. An aperture 92 in second plate 62 is coaxial with aperture 76 in first plate 60.

A third plate 64 may be substantially identical to the first plate 60. These three plates may be held together and attached to the frame 10 by any convenient means. As is clear from FIG. 5, the dimensions, number, and positioning of the apertures in the plates 60, 62 and 64 is dependent upon the means employed to rotate said strand clamps and may be varied or modified to accommodate the specific desires of one skilled in the art. Further, related items such as bearings, sleeves, guides, retainers, gears, couplings, etc., may be added or omitted as desired.

Referring now to FIGS. 3 and 4, right strand clamp 38 comprises a flat blade portion 94 attached, at its first end 95, substantially perpendicular to the surface of a disc 96 whose diameter is generally larger than that of the respective driven shaft 72. An access slot 97 extends radially from the approximate center of said disc 96 to its circumference. The disc 96 is attached concentrically to one end of the shaft 72, with slot 71 in said shaft in alignment with slot 97 of disc 96. The blade portion 94 includes a tooth 101 defining a slot 98 near the second end 100 of said blade 94 and opening to one side. A generally radial indentation 102 is mediate said first end 95 and said slot 98 and opens to the same side as said slot 98. A resilient yet relatively stiff arm 104 is attached to said disc 96 on the same surface as the blade 94, but on the side opposite the slot 97. Said arm 104 has a J-shaped distal end 106 which is oriented in the same direction as blade slot 98 and may extend thereinto. Left strand clamp 36 is a mirror image of right strand clamp 38, and like parts thereof are identified by the same part numbers in the drawings. The second strand clamp is attached in a similar manner to the second driven shaft. The strand clamps 36 and 38 may be modified or varied as desired by one skilled in the art to releasably retain the strands of a bowstring.

OPERATION OF THE PREFERRED EMBODIMENT

Figure 6A:
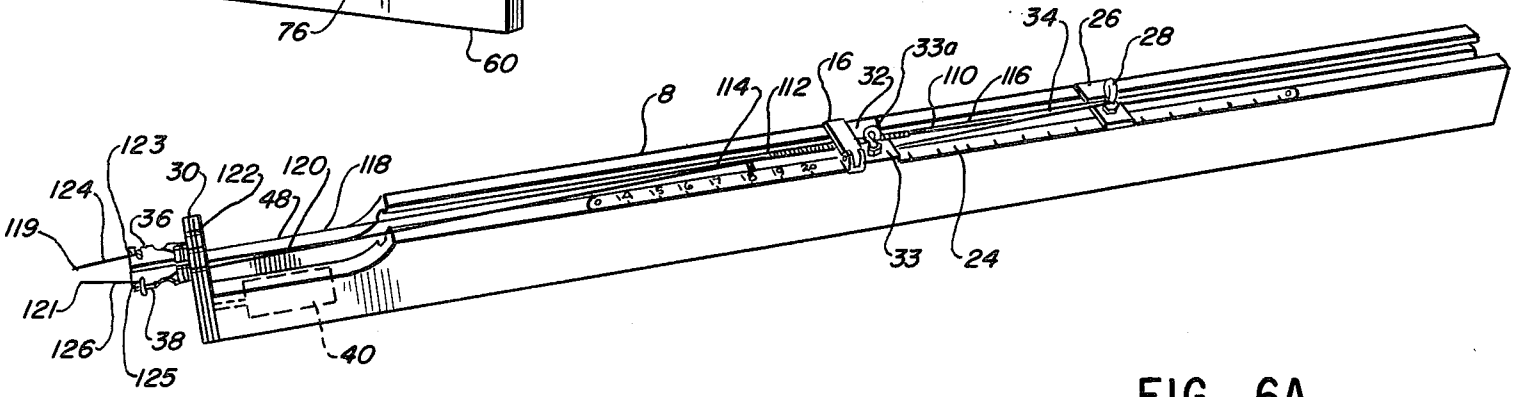
FIGS. 6A through 6D are perspective views showing a method for making an eye in a string employing teachings of this invention.

Referring now to FIG. 6A, the apparatus 8 is shown loaded with a bowstring 110, comprising a plurality of strands wrapped circumferentially by a center serving 112. Such a bowstring typically is waxed, which may assist in the formation and retention of the eye as described herein. The string 110 is clamped, generally at its center depending upon the desired location of the center serving on the completed bowstring, and held in position by the string clamp 16. The string length stop 32 is fixed in position with reference to the string length scale 24. While the scale 24 is provided as an accurate reference, the actual position of the string length clamp 32 for a string of a desired length depends upon the specific desires of the archer and varies with, inter alia, the number and type of strands and the number of twists to complete the eye. Tensioning means 26 is fixed in any convenient position along the frame 10 to cause the tensioner 34 to urge the string clamp 16 away from the splicing head 30 and into abutting contact with the stop 32 to insure that the initial length of the bowstring 110 between the string clamp 16 and the strand clamps 36 and 38 is appropriate for the desired length bowstring.

The first end 114 of the bowstring 110 is placed toward the splicing head 30. The second end 116 (not shown in its full length, for clarity) may be placed anywhere convenient. The strands of said first end 114 are preferably substantially evenly divided into two bundles 118 and 120, or they may be divided otherwise to accommodate a particular archer's desires. One of said bundles of strands is threaded onto and engaged upon either one of the rotatable strand clamps 36 and 38. This is accomplished by passing each bundle through the slot 122 in the splicing head 30, said slot 122 resulting from the alignment of the slots 78 and 82 of the first and third plates 60 and 64 with the port 90 of the second plate 62. See also FIG. 6B. In alignment with the slots 122, and with one another as noted before, are the slots 97 in the discs 96 of the strands clamps, the slots 71 in the shafts 72, and the slots 87 in the driven gears 86. The alignment of these slots and the placement of said bundles in said slots near the center of rotation of said strand clamps allows each bundle to be longitudinally twisted along its length by the rotatable clamps. Each bundle is placed over the blade 94 of the strand clamp and threaded over the radial identation 102 to the opposite side of the blade having the arm 104 adjacent thereto. The bundle is further threaded over the tooth 101, through the slot 98, over the J-shaped distal end 106 of the arm 104, and extended longitudinally beyond the strand clamp a predetermined distance to define a bundle tail 124, see FIG. 6A. The exact geometry of threading the bundle through the strand clamp is not critical and many variations are possible to releasably retain the bundle thereat. The length of the bundle tail extending beyond the clamp is typically four to six inches and substantially determines the length of the first entwined portion 4 of the string 1 as shown in FIG. 1. The other bundle of strands is threaded onto the remaining strand clamp in a manner identical to the first bundle to define a second bundle tail 126. The bundles are preferably positioned in strand clamps 36 and 38 to remove any slack between said strand clamps and the string clamp 16.

Keeping the bundle tails 124 and 126 separate, the strand clamps 36 and 38 are both rotated in a first direction a predetermined number of times, such as 36 times clockwise, by driving the means 40 to put temporary longitudinal twists into each bundle 118 and 120. The free ends 119 and 121 of said bundles are allowed to rotate as the clamps 36 and 38 are rotated. As a result, the bundle tails 124 and 126 have no twists, and the twists induced are confined between the strand clamps 36 and 38 and the center serving 112.

Figure 6B:
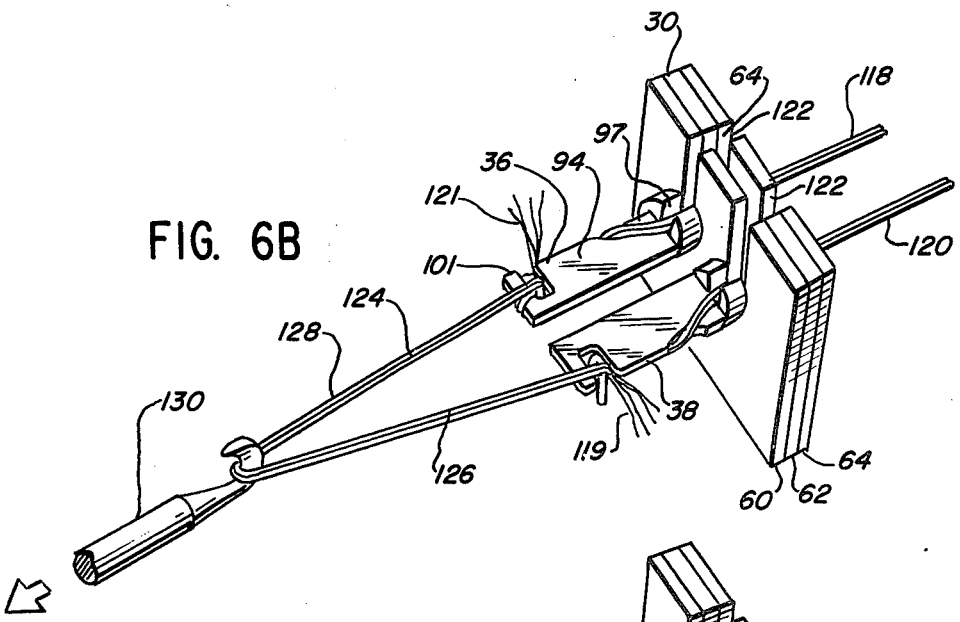
Figure 6C:
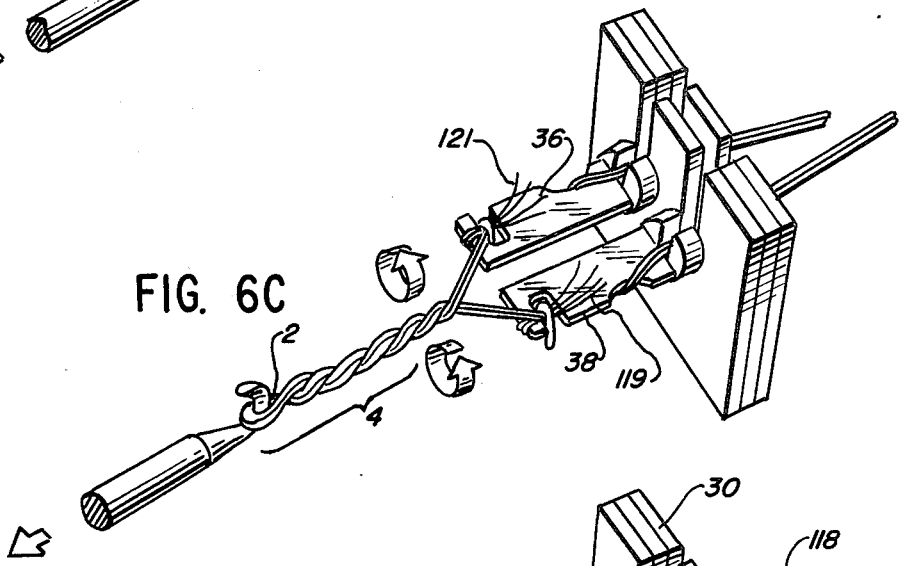

Referring also to FIG. 6B, the bundle tail 124, with its first end 123 remaining in the strand clamp 36, is crossed over and its end 119 is threaded onto the other strand clamp 38. The end 121 of the other bundle tail 126 is similarly threaded onto strand clamp 36. The two bundle tails 124 and 126 now form an overlapped bight portion 128 between the two strand clamps. By a hook 130 or other similar device, the operator catches the center of the overlap portion 128 and draws it away from the splicing head 30 to a first position away from the strand clamps a distance approximately equal to one half the length of the original bundle tails 124 and 126, or until the ends 119 and 121 of the bundle tails 126 and 128 are about to be pulled free of the strand clamps 36 and 38, as seen in FIG. 6B. This action also draws the center serving 112 and the string clamp 16 toward the splicing head 30 and away from the string length clamp 32, but the tension device 34 keeps the bundles 118 and 120 relatively taut. With hook 130 remaining in said first position, the strand clamps 36 and 38 are rotated in a second opposite direction a given number of turns, such as 18 turns counterclockwise as indicated in FIG. 6C, to put longitudinal twists into each leg or half of the overlap portion 128. The two bundles also are permitted to entwine or lay about one another to form the first entwined portion 4 of FIG. 1. This laying will occur simultaneously with the twisting of the bundles if the holder 130 is permitted to rotate, or will occur subsequent to the twisting if the holder 130 is held in position during the twisting and subsequently released for induced rotation. As the strands entwine around one another due to the twisting, an eye 2 forms where said overlap portion 128 was caught on the hook 130. The hook 130 may rotate as described because of the torque exerted by the twisted strands or may be rotated manually. See FIG. 6C.

Figure 6D:
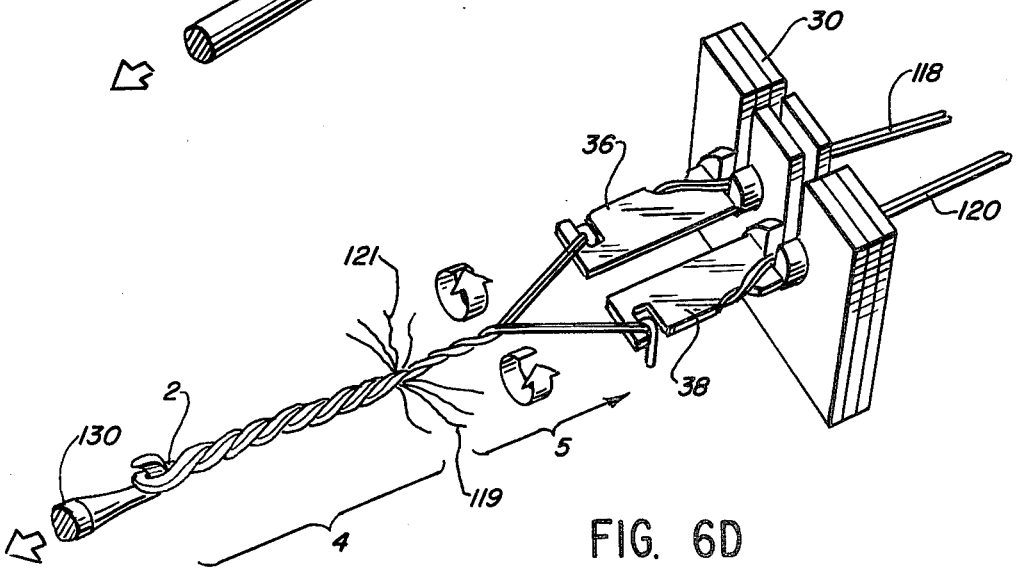

Referring now to FIG. 6D, the hook 130 is pulled to draw the eye 2 still further away from the splicing head 30 to a second position causing the bundle ends 119 and 121 to pull free from their respective strand clamps 38 and 36. With the hook 130 remaining in said second position, the strand clamps are further rotated in said second opposite direction a given number of turns, such as 10 turns counterclockwise as indicated in FIG. 6D, to further lock into place the two bundle tails 124 and 126 and to remove any residual temporary twists put into the bowstring during the preliminary twisting in the first direction. In an ideal situation, the number of twists in the first direction will equal the sum of the number of twists in the second direction so that the strands of bundles 118 and 120 are returned to unwound generally parallel relation. In practice, however, twists may pass through the strand clamp as the bundles are pulled through them. Accordingly, the sum of the number of twists in the second direction may be less than the number of twists in the first direction. The two bundles 118 and 120 are then freed from their strand clamps 36 and 38, as the formation of the eye is complete. The remnants of the bundle tails 124 and 126 may be left as illustrated in FIG. 6D to act as string silencers, as desired by hunters, or they may be trimmed flush with the circumference of the bowstring.

Forming an eye in the opposite end of the string is readily accomplished and is accurately positioned by rotating 180° the string clamp 16, placing said clamp 16 back into contact with the string length clamp 32, and then repeating the eye forming process. It is preferable to reverse the direction of rotation of the strand clamps 36 and 38 for each operation when forming the eye in the opposite end. This reverse formation counteracts the twists in the cables 7 (see FIG. 1) of a compound bow and keeps the bowstring 1 from twisting or rotating about its length as the bow is flexed. Any twisting causes the misalignment of bowstring mounted sights and exerts a torque on the arrow nock where it contacts the string. With the improved eye disclosed herein, the string is neutral and does not have a tendency to unwind, so the reverse twisting is not necessary, and the eye may be formed to suit the particular archer's desires.

The number of turns for each operation is variable and dependent upon the desired bowstring length. This may be coordinated with the string length scale 24 to develop an easy reference table for the making of strings of various lengths.

The invention has been described in detail with particular reference to a preferred embodiment and the operation thereof, but it is understood that variations, modifications, and the substitution of equivalent mechanisms can be effected within the spirit and scope of this invention, particularly in light of the foregoing teachings.

What is claimed is:

1. Apparatus for making an eye in a string having a plurality of strands, said strands capable of forming at least two bundles, including a pair of first retaining means for releasably retaining and longitudinally twisting at least two of said bundles of said strands of said string;

a second retaining means spaced from said first retaining means for gripping and retaining a portion of said string at any of a plurality of positions along said string, said second retaining means spaced from said first retaining means; and means for rotating both of said first retaining means in the same direction, either clockwise or counterclockwise, whereby said bundles retained by said first retaining means may be twisted longitudinally in one direction thereby to provide a pretwist in said bundles and, after said bundles being laid over each other at the distal ends thereof, may be twisted longitudinally in an opposite direction to form said eye.

2. Apparatus as in claim 1 wherein said apparatus includes support means connecting said first retaining means and said second retaining means.

3. Apparatus as in claim 1 or claim 2 wherein said first retaining means includes two rotatable clamp means for releasably retaining bundles of said strands of said string and rotating each of said bundles about its longitudinal axis.

4. Apparatus as in claim 3 wherein said two rotatable clamp means have generally parallel axes of rotation.

5. Apparatus as in claim 1 wherein said first retaining means is adapted to releasably retain one of said bundles and a distal end portion of another bundle.

6. Apparatus as in claim 3 wherein said rotatable clamp means includes:

a generally flat first portion including a first end and a second end having a tooth defining a slot;

a second portion attached to said first end of said first portion; and restraining means cooperating with said slot in said first portion to releasably retain said strands.

7. Apparatus for making an eye in a string as claimed in claim 6 wherein said second portion includes a radial slot extending from the center of said second portion to the edge of said second portion.

8. Apparatus for making an eye in a string as in claim 2 wherein said second retaining means includes:

sliding means attached to said support means for placement in a plurality of selected positions; and string clamp means pivotally attached to said fixable sliding means for retaining said string therein.

9. Apparatus as in claim 1 or claim 2 including biasing means urging said second retaining means away from said first retaining means.

10. Apparatus as in claim 1 or claim 2 including stop means cooperating with said second retaining means to initially position said second retaining means.

11. Apparatus as in claim 1 or claim 2 wherein said rotation means includes a mechanism for translating reciprocating motion into rotational motion of either direction.

12. Apparatus as in claim 3 wherein said rotation means includes power transmitting apparatus connecting said rotation means to said two rotatable clamp means to rotate said clamp means at the same angular velocity.

13. Apparatus as in claim 12 wherein said rotation means includes:

a first shaft through a first gear;

a second slotted shaft through a second slotted gear with said slots in said second gear and said second shaft aligned to form a single slot; and a third slotted shaft through a third slotted gear with said slots in said third gear and said third shaft aligned to form a single slot whereby said first gear directly drives both said second gear and said third gear.

14. Apparatus as in claim 3 wherein said rotatable clamp means includes:

a generally flat first portion including a first end and a second end having a tooth defining a first slot;

a second disc-like portion including a second slot extending from its center to its circumference, said first end of said first portion attached to said second portion generally along a diameter thereof and generally perpendicular thereto; and restraining means attached to said second portion and extending therefrom to cooperate with said first slot in said first portion to releasably retain said strands.

15. Apparatus as in claim 14 wherein said rotation means includes attachment means whereby one of said rotatable clamp means is attached to one end of each of said slotted shafts with the axis of said shaft generally concentric with the axis of said second disc-like portion of said rotatable clamp and said slot in said shaft and said slot in said disc-like portion aligned to form a single slot.

16. Apparatus for making an eye in a string having a plurality of strands, said strands capable of forming at least two bundles, including:

frame means having first and second ends;

two rotatable clamp means attached to said frame means and adjacent said first end for releasably retaining two of said bundles of said strands of said string and rotating each of said bundles about its longitudinal axis;

string clamp means attached to said frame means mediate said first and second ends thereof for retaining said string therein at any of a plurality of positions along said string; and means for rotating both of said rotatable clamp means in the same direction, either clockwise or counterclockwise, whereby said bundles retained by said first retaining means may be twisted longitudinally in one direction thereby to provide a pretwist in said bundles and, after said bundles being laid over each other at the distal ends thereof, may be twisted longitudinally in an opposite direction to form said eye.

17. Apparatus as in claim 16 wherein said string clamp means includes sliding means attached to said frame means for placement in a plurality of selected positions; and pivot means to pivotally attach said string clamp to said sliding means.

18. Apparatus as in claim 16 including a stop means releasably attached to said frame means mediate said string clamp means and said second end of said frame for placement in a plurality of selected positions therebetween.

19. Apparatus as in claim 16 including a biasing means urging said sliding means away from said rotatable clamp means.

20. Apparatus as in claim 16 wherein said rotatable clamp means includes:

a generally flat first portion including a first end and a second end having a tooth defining a first slot;

a second disc-like portion including a second slot extending from its center to its circumference, said first end of said first portion attached to said second portion generally along a diameter thereof and generally perpendicular thereto; and restraining means attached to said second portion and extending therefrom to cooperate with said first slot in said first portion to releasably retain said strands.

21. Apparatus as in claim 16 wherein said rotation means includes a mechanism for translating reciprocating motion into rotational motion of either direction.

22. Apparatus as in claim 16 wherein said rotation means includes power transmitting apparatus connecting said rotation means to said two rotatable clamp means to rotate said clamp means at the same angular velocity.

23. Apparatus as in claim 22 wherein said rotation means includes:

a first shaft through a first gear;

a second slotted shaft through a second slotted gear with said slots in said second gear and said second shaft aligned to form a single slot; and a third slotted shaft through a third slotted gear with said slots in said third gear and said third shaft aligned to form a single shot whereby said first gear directly drives both said second gear and said third gear.

24. Apparatus as in claim 23 wherein said rotation means includes attachment means whereby one of said rotatable clamp means is attached to one end of each of said slotted shafts with the axis of said shaft generally concentric with the axis of said second disc-like portion of said rotatable clamp and said slot in said shaft and said slot in said disc-like portion aligned to form a single slot.

25. Apparatus as in claim 16 wherein said string is a bowstring.

26. A method for making an eye in a string having a plurality of strands, including:

separating a first end portion of said string into a first and a second bundle of strands, each of said bundles having a distal end portion and a body portion;

longitudinally twisting said body portion in a first direction;

overlapping said distal end portions to form a bight comprising a base and two legs adjacent said base;

longitudinally twisting each of said legs in a second direction opposite said first direction and thereby entwining said legs one around the other to form an eye at the base of said bight while untwisting said body portions; and longitudinally twisting a segment of each of said body portions contiguous to said distal end portions in said second direction and thereby entwining said first and second bundles one around the other to assist in retaining said eye.

27. A method for making an eye in a string having a plurality of strands as in claim 26 including making an eye on both ends of said string.

28. A method as in claim 26 wherein said first bundle has substantially the same number of strands as said second bundle.

29. A method as in claim 26 wherein the number of longitudinal twists in said first direction is equal to the number of longitudinal twists in said second direction.

30. A method as in claim 26 wherein said string is waxed.

31. A product made by the method of claim 26 wherein said product is a bowstring.

32. A method for making an eye in a string having a plurality of strands including:

providing apparatus including two rotatable strand retaining means;

separating a first end portion of said string into a first and a second bundle of strands, each of said bundles having a distal end portion and a body portion, meeting at a mediate point;

releasably retaining said mediate points of said first and second bundles in said first and second rotatable strand retaining means, respectively;

rotating said first and second strand retaining means in a first direction to longitudinally twist said body portions in said first direction;

releasably retaining said first distal end portion in said second strand clamp and said second distal end portion in said first strand clamp to form a bight comprising a base and two legs adjacent said base;

holding said base of said bight;

rotating said first and second strand retaining means in a second direction opposite said first direction to longitudinally twist each of said legs in said second direction entwining said legs one around the other to form an eye at the base of said bight while untwisting said body portions;

moving said base away from said strand retaining means to release said distal ends; and rotating said first and second strand retaining means in said second direction to longitudinally twist a segment of each of said body portions contiguous to said legs in said second direction and thereby entwining said first and second bundles one around the other to assist in retaining said eye.

33. A method as in claim 32 including:

providing apparatus also including a second retaining means spaced from said rotatable strand retaining means;

retaining said string at a retention point located on said string other than on said body portion, or distal end portion; and urging said retention point away from said strand retaining means.

34. A method as in claim 32 including making an eye on both ends of said string.

35. A product made by the method of claim 32 wherein said product is a bowstring.

* * * * *